US005560494A

United States Patent [19]

Kumagai et al.

[11] Patent Number: 5,560,494

[45] Date of Patent: Oct. 1, 1996

[54] LOOP-LIKE MATERIAL SORTING DEVICE

[75] Inventors: Masakatsu Kumagai, Aichi-ken; Yoshihisa Fujita, Saitama-ken, both of Japan

[73] Assignees: Toyota Tsusho Corporation; Toyota Metal Co., Ltd., both of Nagoya; Senko Kogyo Co., Ltd., Tokyo, all of Japan

[21] Appl. No.: 543,492

[22] Filed: Oct. 16, 1995

Related U.S. Application Data

[63] Continuation of Ser. No. 217866, Mar. 25, 1994, abandoned.

[30] Foreign Application Priority Data

Mar. 31, 1993 [JP] Japan ..... 5-098641

[51] Int. Cl.[6] ..... B07B 13/05

[52] U.S. Cl. ..... 209/245; 209/365.2; 209/632; 209/674

[58] Field of Search ..... 209/243, 244, 209/245, 365.1, 365.2, 366, 366.5, 367, 632, 659, 660, 674, 677, 678

[56] References Cited

U.S. PATENT DOCUMENTS

| | | | |
|---|---|---|---|
| 2,049,870 | 8/1936 | Schiff | 209/365.2 X |
| 3,143,212 | 8/1964 | Miller | 209/674 X |
| 3,567,012 | 3/1971 | Mendoza | 209/365.2 X |
| 4,143,769 | 3/1979 | Ripple | 209/674 X |
| 5,112,474 | 5/1992 | Douglas | 209/245 X |

FOREIGN PATENT DOCUMENTS

| | | | |
|---|---|---|---|
| 76327 | 9/1970 | Germany | 209/674 |
| 5-819337 | 2/1983 | Japan . | |
| 58-16714 | 7/1983 | Japan . | |
| 2-17281 | 2/1990 | Japan . | |
| 3-22574 | 3/1991 | Japan . | |

*Primary Examiner*—William E. Terrell
*Assistant Examiner*—Tuan Nguyen
*Attorney, Agent, or Firm*—Oblon, Spivak, McClelland, Maier & Neustadt, P.C.

[57] ABSTRACT

A loop-like material sorting device includes a comb-like member arranged with an inclination in a supply path supplied with materials to be sorted and formed in a row at a pitch corresponding to the shape or size of loop-like materials, and a vibrating device connected to the comb-like member and for applying the mechanical vibration to the comb-like member, wherein the loop-like materials contained in the materials to be sorted are caught by the comb-like member and then guided to the free end by the inclination of the comb-like member and the vibration applied to the comb-like member by the vibrating device to enable the sorting of the loop-like materials.

12 Claims, 5 Drawing Sheets

LOOP-LIKE MATERIAL SORTING DEVICE

This application is a Continuation of application Ser. No. 08/217,866, filed on Mar. 25, 1994, now abandoned.

BACKGROUND OF THE INVENTION

1. Field of the Invention

This invention relates to a loop-like material sorting device for sorting out loop-like materials such as cut pieces of wire harnesses and other.

2. Description of the Prior Art

In a conventional nonferrous material sorting line utilizing sorting devices including a dry fluidized bed sorting device (See Japanese Patent Publication No. 58-19337) having a sorting deck S planted with a large number of rod-like projections T as shown in FIG. 5, any device for sorting out loop-like materials such as wire harnesses and other has not been utilized.

The dry fluidized bed sorting device in the conventional nonferrous material sorting line is constituted such that a large number of rod-like projections T are formed on the sorting deck S in order to promote the separating operation. Therefore, in case of sorting out nonferrous materials containing crushed pieces of automobiles, for example, since loop-like materials such as cut pieces of wire harnesses are not sorted out and removed in advance, the nonferrous materials to be sorted contain a large number of such loop-like materials, which are almost liable to be caught by the projections T and it involves problems in that the vibrations are hindered, the flow resistance is increased so as to thus reduce the sorting quantity per unit time, and in an extreme case the flow of materials to be sorted is stopped so to lead to disabling the sorting operation.

SUMMARY OF THE INVENTION

An object of the present invention is to sort out loop-like materials.

Another object of the present invention is to stably maintain the sorting capacity of loop-like materials over a long period of time.

A further object of the present invention is to prevent flow resistance from increasing due to loop-like materials.

A still further object of the present invention is to prevent the sorting efficiency and the sorting quantity per unit time from being reduced due to loop-like materials.

A yet further object of the present invention is to avoid disabling of the sorting operation due to loop-like materials.

A yet further object of the present invention is to provide a loop-like material sorting device based on a technical concept of the present invention to the effect that a comb-like member for catching loop-like materials is arranged in a supply path of materials to be sorted, and the loop-like materials are sorted out and removed by the vibrations and inclination of the comb-like member, while the materials to be sorted other than the loop-like materials are dropped downwards.

A yet further object of the present invention is to provide a loop-like material sorting device comprising a comb-like member arranged with an inclination in a supply path supplied with materials to be sorted, and formed in a row at a pitch in response to the shape of loop-like materials, and a vibrating device connected to the comb-like member and for applying the mechanical vibration to the comb-like member, wherein the loop-like materials contained in the materials to be sorted are caught by the comb-like member, and then guided to the free end of the comb-like member by the inclination of the comb-like member and the vibration applied to the comb-like member by the vibrating device to enable sorting of the loop-like materials.

A yet further object of the present invention is to provide a loop-like material sorting device comprising a comb-like member having parallel teeth arranged with an inclination to the longitudinal axis of a supply path supplied with materials to be sorted, and formed in a row with a pitch smaller than the size of loop-like materials, and a rotary vibrating device integrally connected to a root portion of the comb-like member and rotated so as to apply the reciprocating vibration in the longitudinal direction of the teeth of the comb-like member, wherein the loop-like materials contained in the materials to be sorted are caught by each tooth of the comb-like member, and then guided to the free end of each tooth by the inclination of the comb-like member and the vibration applied to the comb-like member due to the rotation of the rotary vibrating device to enable the sorting of the loop-like materials.

According to the loop-like material sorting device of the present invention, the vibrating device applies the mechanical vibration to the comb-like member, and when the materials to be sorted are supplied to the comb-like member through the supply path, only the loop-like materials are caught by the comb-like member, while the materials to be sorted other than the loop-like materials are passed through a gap in the comb-like member and dropped downwards. Then, the caught loop-like materials are guided to the free end by the inclination and vibration of the comb-like member to sort out the loop-like materials.

Further, according to the loop-like material sorting device of the present invention, the rotary vibrating device applies the reciprocating vibrations in the longitudinal direction of the teeth of the comb-like member, and when the materials to be sorted are supplied in the longitudinal direction of the teeth of the comb-like member through the supply path, only the loop-like materials are caught by the comb-like member, when the materials to be sorted other than the loop-like materials are passed through a gap between the teeth of the comb-like member and dropped downwards. Then, the caught loop-like materials are guided to the free end of each tooth by the inclination of the comb-like member and the reciprocating vibration applied in the longitudinal direction of the teeth of the comb-like member.

The loop-like material sorting device of the present invention has the effect of making it possible to sort out and remove the loop-like materials by the inclination and vibration of the comb-like member, while preventing the reduction of a sorting quantity of nonferrous materials per unit time.

Further, the loop-like material sorting device of the present invention has the effect of making it possible to further effectively sort out and remove the loop-like materials by the inclination of the comb-like member and the vibrations applied in the longitudinal direction of the teeth of the comb-like member, while further effectively preventing the reduction of a sorting quantity of nonferrous materials per unit time.

BRIEF DESCRIPTION OF THE DRAWINGS

The foregoing and other objects and features of the invention will become apparent from the following description of preferred embodiments of the invention with reference to the accompanying drawings, in which.

DESCRIPTION OF THE PREFERRED EMBODIMENTS

Figure 1:
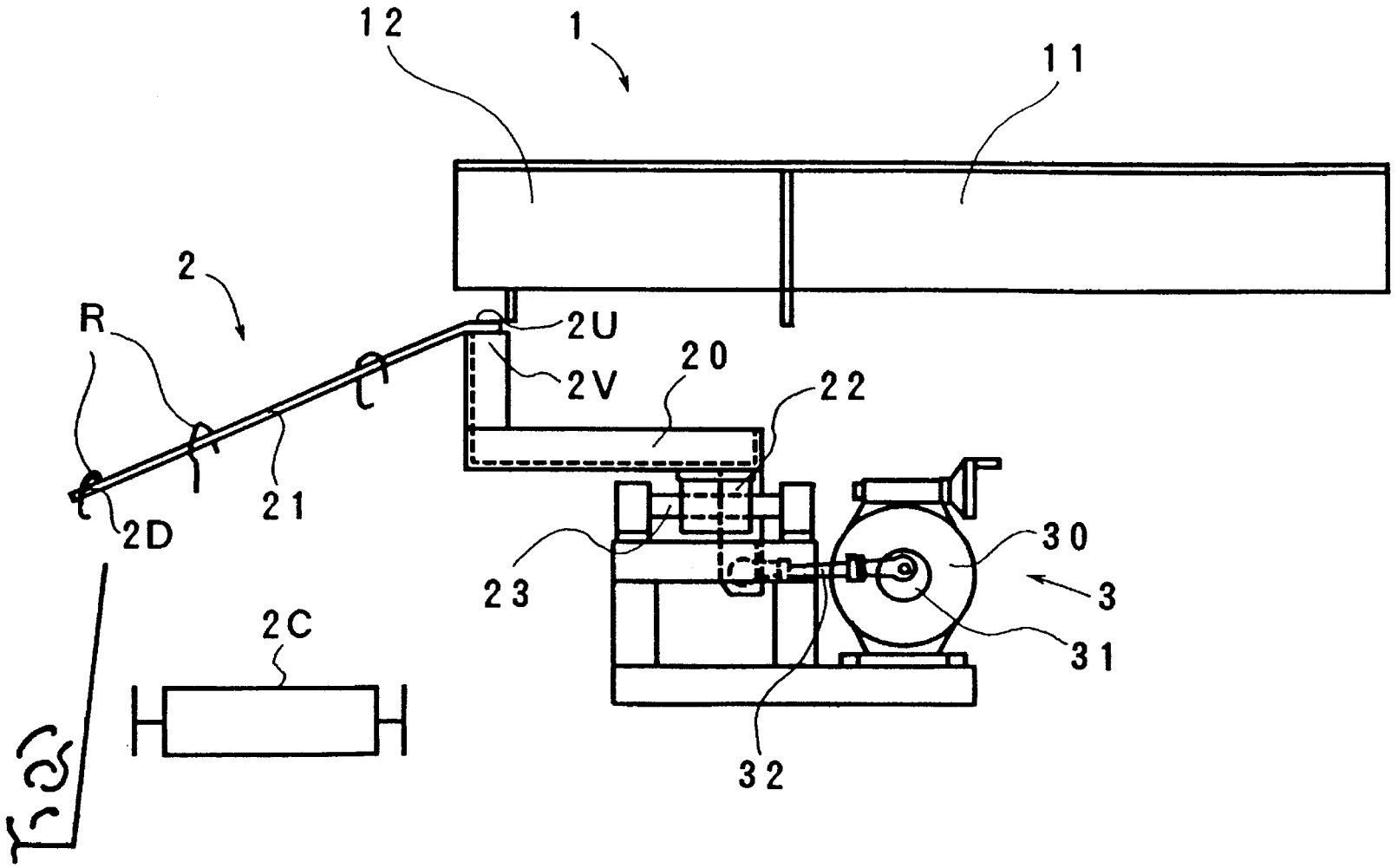
FIG. 1 is a side view showing a loop-like material sorting device as a first preferred embodiment of the present invention.
Figure 2:
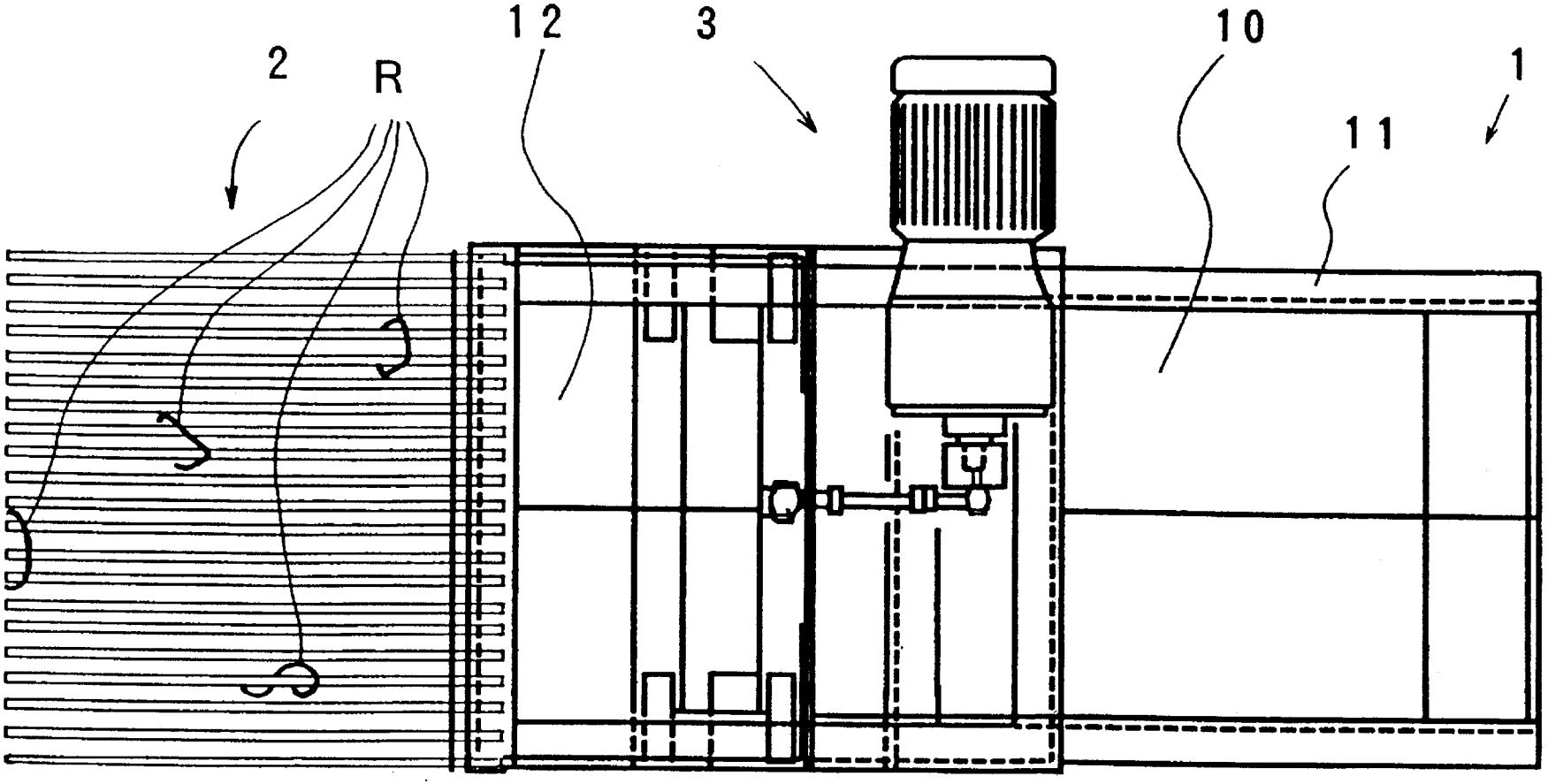
FIG. 2 is a plan view showing the loop-like material sorting device of the first preferred embodiment.

As shown in FIGS. 1 and 2, a loop-like material sorting device as a first preferred embodiment of the present invention comprises a supply path or supply member 1 supplied with nonferrous materials containing loop-like materials R such as wire harnesses, a comb-like member 2 having a plurality of teeth 21 arranged in a row in proximity to the open end of the supply path 1, and a rotary vibrating device 3 causing an eccentric motion reciprocating a fixing member 20 of the comb-like member 2 in the longitudinal direction of the teeth of the comb-like member 2.

The supply path 1 is constituted by a rectangular path 10 having vertical walls 11 formed on both sides in the width direction, and a left end 12 of the supply path 1 in FIG. 1 is the open end for supplying the nonferrous materials containing the loop-like materials R.

The comb-like member 2 is constituted by approximately 20 pieces of smooth-faced stainless steel rods which are arranged in parallel with a pitch of 20 mm to constitute the teeth 21. The comb-like member 2 has one fixed end 2U on the upper side and is arranged with an inclination at an angle of approximately 25° with respect to the horizontal plane. The other end 2D of the comb-like member 2 on the lower side is disposed so as to be located outside of the width of a conveyer 2C arranged below the comb-like member 2, and a case for accommodating the sorting loop-like materials R is arranged below the comb-like member 2.

The upper end 2U of the comb-like member 2 is fixedly attached to a vertical upper end 2V of the rectangular fixing member 20 having an L-shaped vertical section. A slide member 22 having a circular hole is fixedly attached to both undersides of the fixing member 20 in the width direction. A rod-like guide member 23 fixedly attached below the fixing member 20 is inserted into the slide member 22, and the fixing member 20 is so as arranged to be movable leftwards and rightwards in the drawing along the guide member 23.

The rotary vibrating device 3 comprises a motor 30 arranged below the supply path 1, a disc 31 fixedly attached to one end of a rotary shaft of the motor 30, and a connecting rod 32 for connecting one end thereof on the disc 31 to a connecting portion 24 arranged below the fixing member 20. When the disc 31 is rotated in accordance with the rotation of the motor 30, the connecting rod 32 is eccentrically moved to make it possible to apply the reciprocating vibration to the fixing member 20, which is adapted to fixedly attach the comb-like member 2 to one end 2V, leftwards and rightwards in the drawing.

According to the loop-like material sorting device as the first preferred embodiment described above, the rotary vibrating device 3 applies the reciprocating vibrations to the comb-like member 2 leftwards and rightwards in the drawing through the connecting rod 32 due to the rotation of the disc 31 in accordance with the rotation of the motor 30. Thus, when the nonferrous materials containing the loop-like materials R are supplied to the comb-like member 2 through the supply path 1, the loop-like materials R are caught by the teeth 21 of the comb-like member 2, then guided downwards by the inclination of the teeth and the reciprocating vibration applied in the longitudinal direction of the teeth, and dropped from the lower end 2D into the case.

On the other hand, nonferrous materials other than the loop-like materials R are passed through the gap between the teeth, then dropped onto the conveyer 2C arranged normal to the supply path 1, and supplied to the next station through the conveyer 2C, since the pitch of the comb-like member 2 is predetermined as described above.

The loop-like material sorting device serving as the first preferred embodiment having the operation described above has the effect of making it possible to sort out and remove the loop-like materials R, while further effectively preventing a reduction of the sorting efficiency of the nonferrous materials in the subsequent processes and also the reduction of the sorting quantity of the nonferrous materials per unit of time, since the loop-like materials R are effectively guided downwards by the linearly reciprocating vibration in the longitudinal direction of the teeth 2 of the comb-like member 2.

Further, the loop-like material sorting device in the first preferred embodiment has the effect of stably maintaining the guiding operation and the sorting capacity of the loop-like materials R over a long period of time, since the comb-like member 2 comprises stainless steel rods.

Figure 3:
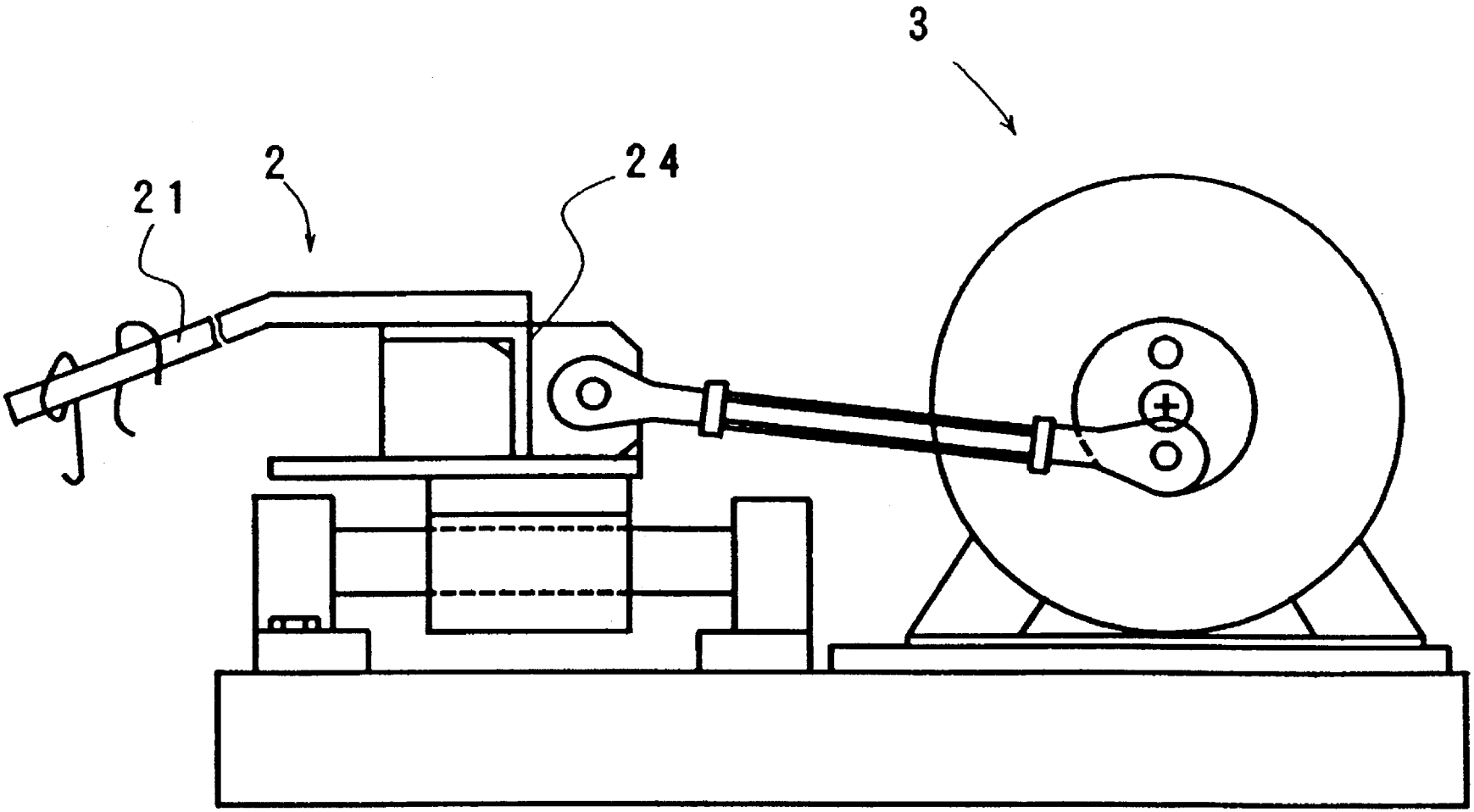
FIG. 3 is a side view showing an essential portion of a loop-like material sorting device of a second preferred embodiment of the present invention.

As is apparent from FIG. 3, a loop-like material sorting device as a second preferred embodiment of the present invention is different from the device in the first preferred embodiment in that the fixing member 20 of the comb-like member 2 in the device as the first preferred embodiment is altered so as to be a lightweight fixing member 24 of small size. Thus, the loop-like material sorting device as the second preferred embodiment has the effect of increasing the vibrations of the comb-like member 2, while realizing energy savings by lowering the drive current of the motor.

Figure 4:
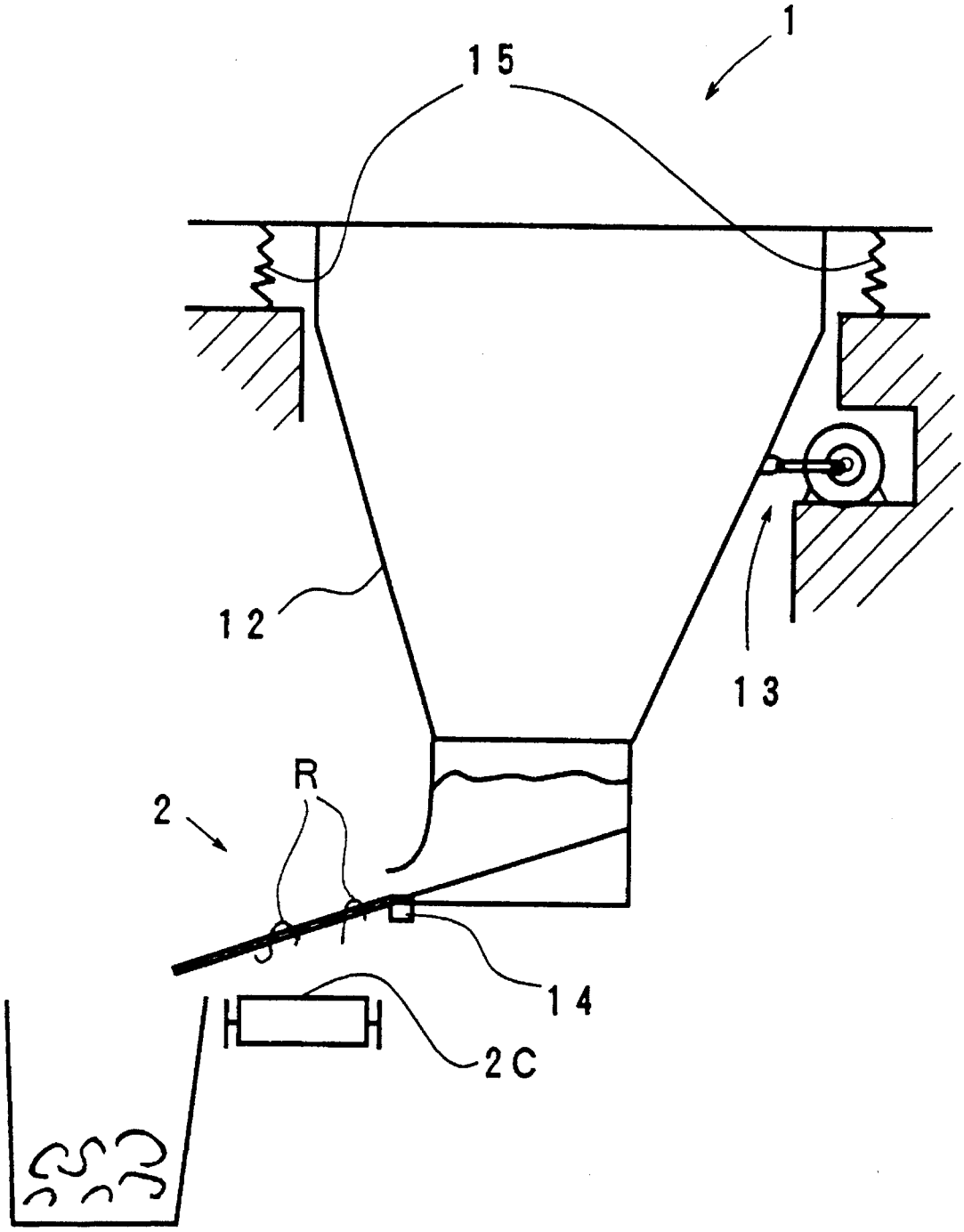
FIG. 4 is a side view, partly broken-away, showing a loop-like material sorting device of a third preferred embodiment of the present invention.
Figure 5:
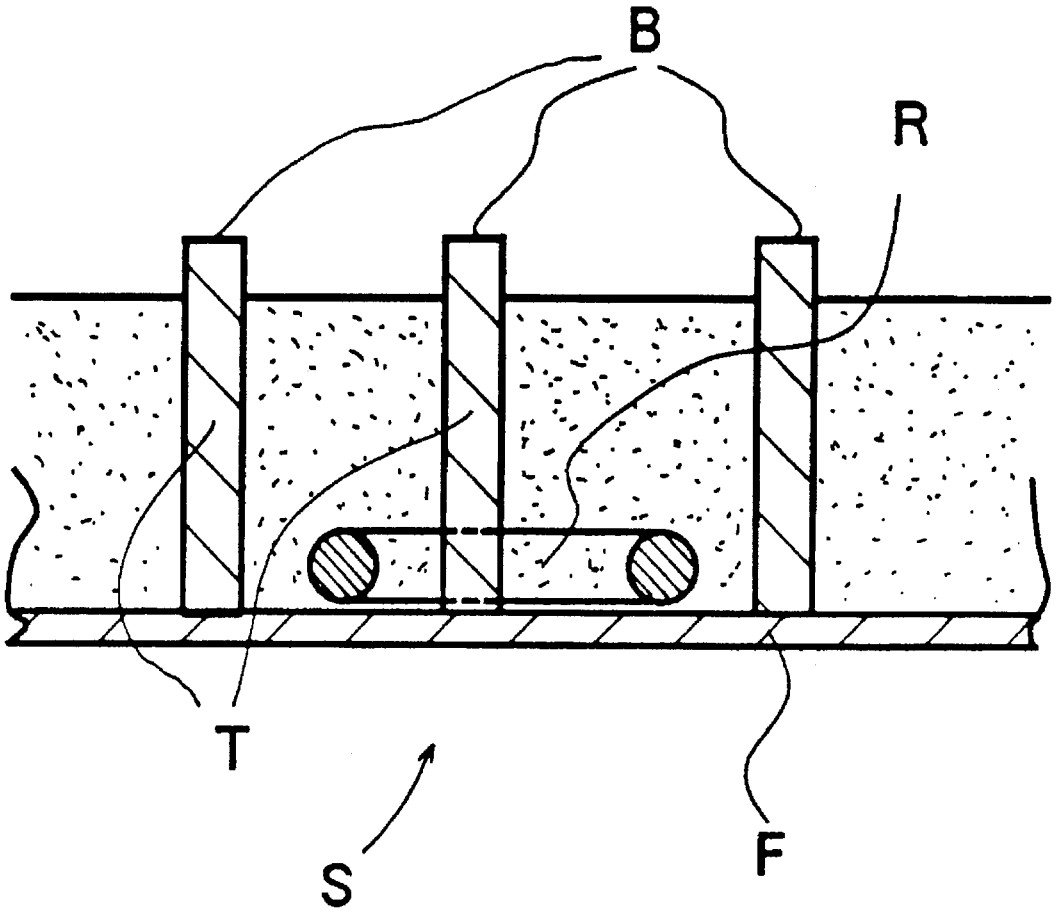
FIG. 5 (PRIOR ART)
FIG. 5 is a sectional view showing an essential portion of a prior art device.

As shown in FIG. 4, a loop-like material sorting device in a third preferred embodiment of the present invention is different from the devices of the first and second preferred embodiments in that the supply device 1 is constituted by a hopper 12 for temporarily storing the nonferrous materials containing the loop-like materials R for batch processing, and the hopper 12 supported by springs 15 is vibrated itself by an eccentrically moved vibrating device 13 so as to enable a stable supply of the nonferrous materials. Therefore, the comb-like member 2 is fixedly attached to a lower end 14 of the hopper 12 to vibrate the comb-like member 2 by making use of the vibration due to the eccentric motion of the hopper 12, without vibrating the comb-like member 2 by the independent vibrating device 3 like the first and second preferred embodiments described above. Accordingly, the loop-like material sorting device as the third preferred embodiment has the effect of dispensing with the independent vibrating device used for the comb-like member 2, in addition to the effects similar to those in the first and second preferred embodiments described above.

The preferred embodiments described above are illustrative and not restrictive, and it is to be understood that other embodiments and modifications are possible without departing from the technical concept of the invention which will be recognized by those skilled in the art on the basis of the claims, the description of the invention and the drawings.

The term "loop-like material" is merely described herein and is not restrictive to only those of completely closed-loop shape, and it is a matter of course that as long as the materials to be sorted have respectively a partially circular portion like those of S-shape, J-shape and C-shape so as to be caught and held by the comb-like member 2, the loop-like material sorting device of the present invention can be adapted to remove such the materials to be sorted.

The conventional device arranged in combination with the dry fluidized bed sorting device is typically described herein and is not restrictive, and it is to be understood that as long as the loop-like material sorting device of the present invention is arranged on the upstream portion of a sifting device using a screen, an air table using a rectifying lattice or like devices to remove the loop-like materials, it is possible to prevent a reduction of performance of each of the devices described above and to avoid disabling the sorting operation.

What is claimed is:

1. A loop-like material sorting device, comprising:

a supply hopper supplied with material to be sorted, said supply hopper having an end portion;

a comb-like member connected at an axial end thereof to a lower end portion of the supply hopper, said comb-like member having teeth formed in a row, being downwardly inclined and having a free end; and a vibrating device connected to the supply hopper and located above the lower end of the hopper, the vibrating device applying mechanical vibration to the supply hopper;

elastic supports supporting said hopper at an upper portion of the hopper, said elastic supports permitting vibration of the hopper by said vibrating device;

wherein the loop-like materials contained in the materials to be sorted are caught by the comb-like member and are guided to the free axial end of the comb-like member by the inclination of the comb-like member and wherein vibrations are applied to the hopper by the vibrating device so as to enable sorting of the loop-like materials.

2. A loop-lie material sorting device according to claim 1, wherein said comb-like member has a longitudinal axis which is perpendicular to a direction of movement of unsorted materials thereby along a supply path for supplying the unsorted materials.

3. A loop-like material sorting device according to claim 1, wherein the teeth of the comb-like member are arranged with a pitch smaller than said materials to be sorted.

4. A loop-like material sorting device according to claim 3, wherein the teeth of said comb-like member are arranged parallel to one another.

5. A loop-like material sorting device according to claim 3, wherein the teeth of said comb-like member comprise smooth-face rod-like members.

6. A loop-like material sorting device according to claim 5, wherein the teeth of said comb-like member comprise rod members arranged with an inclination at a fixed angle with respect to a horizontal plane.

7. A loop-like material sorting device according to claim 6, wherein said comb-like member comprises stainless steel rods arranged parallel with a pitch of 2 mm and at an angle of inclination of approximately 25° with respect to the horizontal plane.

8. A loop-like material sorting device according to claim 1, wherein said comb-like member is positioned at an outlet portion of the hopper.

9. A loop-like material sorting device according to claim 8, wherein said vibrating device comprises an eccentric motion generating device generating an eccentric motion of the hopper.

10. A loop-like material sorting device according to claim 5, wherein said rod-like member comprises a rod member having a circular cross section.

11. A loop-like material sorting device according to claim 10, wherein said rod-like members comprise solid rods, one end of each of which are fixed to an lower end of said supply hopper and the pitches of each of which from one end to the other end in axial directions thereof are constant.

12. A loop-like material sorting device, comprising:

a supply hopper supplied with material to be sorted, said supply hopper having an end portion;

a comb-like member connected through an axial end thereof to the end portion of the supply hopper, said comb-like member having teeth formed in a row, being downwardly inclined and having a free end; and a vibration device connected to the supply hopper and applying mechanical vibration to the supply hopper;

wherein the loop-like materials contained in the materials to be sorted are caught by the comb-like member and are guided to the free axial end of the comb-like member by the inclination of the comb-like member and wherein the vibrations are applied to the hopper by the vibrating device so as to enable sorting of the loop-like materials;

said vibrating device comprising an eccentric motion generating device generating an eccentric motion of the hopper and wherein said eccentric motion generating device includes a motor, a disc fixedly attached to one end of a rotary shaft of the motor and a connecting rod having one end anchored to one point of the disc and the other end anchored to an end of said hopper to make it possible to move the material to be sorted within the hopper downwards due to the eccentric motion of said hopper, while sorting out the loop-like materials by applying the vibrations of said hopper to said comb-like member.

* * * * *